United States Patent [19]

Steinwart et al.

[11] 4,227,502

[45] Oct. 14, 1980

[54] FUEL INJECTION SYSTEM

[75] Inventors: Johannes Steinwart, Obersulm-Willsbach; Armin Baüder, Neckarsulm, both of Fed. Rep. of Germany

[73] Assignee: Audi NSU Auto Union, Neckarsulm, Fed. Rep. of Germany

[21] Appl. No.: 966,490

[22] Filed: Dec. 4, 1978

[30] Foreign Application Priority Data

Dec. 24, 1978 [DE] Fed. Rep. of Germany ..... 2758065

[51] Int. Cl.[3] ..... F02D 3/02; F02D 1/06

[52] U.S. Cl. ..... 123/454; 123/452

[58] Field of Search ..... 123/140 MC, 139 AW, 123/140 FG; 137/614.11; 251/210, 61, 61.2

[56] References Cited

U.S. PATENT DOCUMENTS

| | | | |
|---|---|---|---|
| 2,618,222 | 11/1952 | Davies | 123/140 MC |
| 2,623,509 | 12/1952 | Gold | 123/140 MC |
| 2,954,021 | 9/1960 | Hurst | 123/140 MC |
| 3,919,992 | 11/1975 | Eckart | 123/139 AW |
| 3,930,481 | 1/1976 | Eckart | 123/139 AW |
| 3,951,121 | 4/1976 | Passera | 123/139 AW |
| 3,994,267 | 11/1976 | Eisele | 123/139 AW |
| 4,090,487 | 5/1978 | Stumpp | 123/139 AW |
| 4,091,832 | 5/1978 | Snyder | 137/625.66 |

FOREIGN PATENT DOCUMENTS 551869 3/1943 United Kingdom ..... 123/140 FG

*Primary Examiner*—Charles J. Myhre
*Assistant Examiner*—Carl Stuart Miller
*Attorney, Agent, or Firm*—Kane, Dalsimer, Kane, Sullivan and Kurucz

[57] ABSTRACT

A fuel injection system for a mixture-compressing externally ignited internal combustion engine includes a flow sensing member (3) arranged in an air intake duct (1), the member (3) moving in accordance with the quantity of air flowing through the duct so as to actuate a fuel metering valve (7) and to dispense a quantity of fuel to fuel injection nozzles (9) of the engine. The pressure difference in the metering valve (7) is maintained constant by means of a pressure sensitive valve (11) and a differential pressure control valve (20), each of which has two chambers separated by a diaphragm (12 and 21). The differential pressure control valve (20) is actuated on both sides by springs (34, 36 and 54) whose loading stress can be varied according to engine operating parameters. The loading stress of the springs is adjusted by devices for full-load fuel concentration and cold-starting fuel enrichment, and also a device responsive to air pressure changes.

8 Claims, 1 Drawing Figure

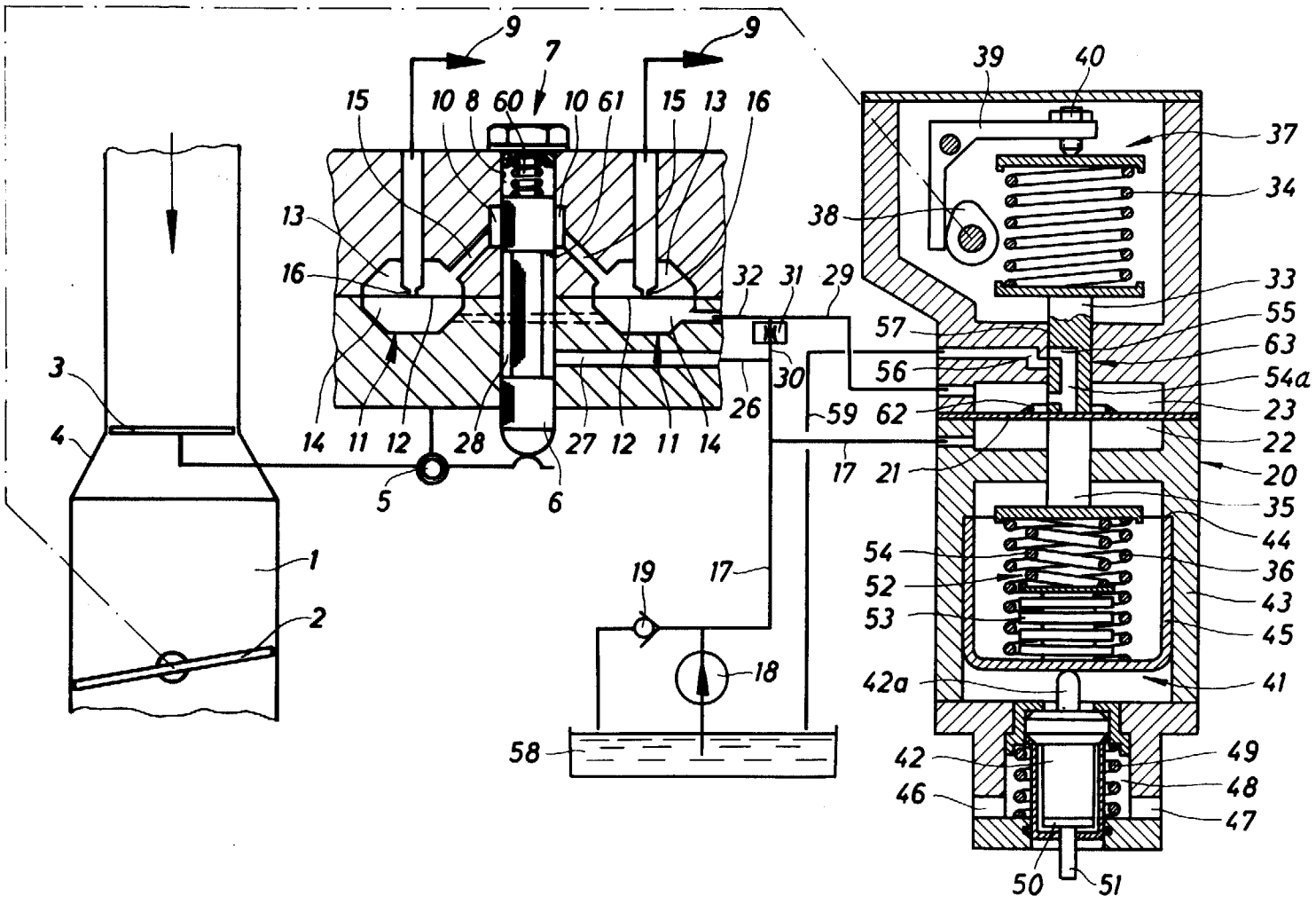
37
34
33
55
63
54a
23
22
20
35
44
36
43
45
41
49
48
47
40
39
38
57
56
62
21
54
52
53
42a
42
46
51
50
29
59
17
31
30
26
32
16
13
15
9
61
10
7
60
8
28
6
14
11
12
27
18
19
58
5
1
2
3
4

FUEL INJECTION SYSTEM

This invention relates to a fuel injection system for a mixture-compressing spark-ignition internal combustion engine having continuous fuel injection.

One known system of this type (German Offenlegungsschrift No. 23 49 688) is so constructed that the differential pressure regulating valve and its first chamber is connected to an additional pressure control valve located in the reverse movement pipeline (back-flow pipeline) and also to a further system pressure valve which is connected to the second chamber. The pressure control valve has an adjusting motor, and its task is to regulate the pressure of the fuel flowing through in dependence upon motor characteristics. The disadvantage in this construction is that the differential pressure valve and pressure control valve occupies a relatively large amount of space, is costly to manufacture and dosing errors may occur as a result of the valves acting independently of each other.

The object of the invention is to produce a fuel injection system of this type having a differential pressure valve which is constructed in a space-saving manner and ensures a reliable mode of operation.

Broadly stated, the invention is directed to a fuel injection system for a mixture-compressing externally ignited internal combustion engine having continuous fuel injection, an air intake duct, and an adjustable throttle valve in said intake duct, comprising a flow sensing element in the intake duct arranged to move in accordance with the quantity of air flowing through said intake duct and to actuate a fuel metering valve for dispensing a quantity of fuel which is substantially proportional or related to the quantity of air, means for maintaining a substantially constant pressure difference through the metering valve including a pressure-sensitive valve having two chambers separated from each other by a movable partition element, and a pressure control valve which also has two chambers separated from each other by a movable partition element, the first chamber of said pressure sensitive valve being subject to the pressure downstream of said metering valve and communicating with a fuel injection nozzle of the engine through a valve aperture controlled by the associated partition element, while the second chamber of said pressure sensitive valve communicates with the first chamber of said differential pressure control valve, which in turn communicates with a return line via a spring-loaded valve element which is controlled by the partition element of said differential pressure control valve, whilst the second chamber of said differential pressure control valve is actuated by the pressure upstream of said metering valve, and the partition element of said differential pressure control valve is actuated on both sides by resilient elements, whose loading stress can be varied according to engine operating parameters. Preferably, the movable partition elements are diaphragms and the resilient elements are springs.

In accordance with the invention the diaphragm of the differential pressure control valve is actuated by springs on both sides, whose loading stress can be varied depending upon operating parameters. This results in a differential pressure control valve having a simple and compact construction, which has a small space requirement and, in contrast to previous constructions combines the function of differential pressure valve and pressure control valve. Moreover, several operating characteristics which influence the fuel dosing are able to act directly on the differential pressure control valve.

The springs can engage a device for full-load fuel concentration, a device for cold-starting fuel enrichment and a device responsive to the air pressure, these devices adjusting the tension of the springs in such a way that the valve controlled by the diaphragm is actuated in the opening direction with a full load and during cold running, and in the closing direction with falling air pressure. As a result of this, a differential pressure can be produced which is suited to the operating state of the engine.

The transmission of the spring tension to the diaphragm can be effected by using a spring which is linked to the first chamber of the differential pressure control valve and supported against the diaphragm by a projecting member, for example a bolt which penetrates the first chamber, and by a spring which is linked to the second chamber and supported against the diaphragm by a further projecting member which penetrates the second chamber.

The device for full-load fuel enrichment can rest against the spring which is linked to the first chamber, and depending upon the position of the throttle valve during a full load, can be adjusted in a direction which increases the tension of the spring. As a result of the increase in the spring tension, an increase in the pressure difference between the two chambers and therefore a greater fuel dosing can be achieved.

The device for cold-starting fuel enrichment can rest by means of a spring plate against the spring linked to the second chamber, and by means of an adjusting element which reacts to the temperature of the engine, can be moved during cold-running, in a direction, which reduces the tension of the spring. By lowering the tension of this spring, an increase in the pressure difference and consequently a greater fuel dosing can occur. The engine temperature can, for example, be determined by measuring the cooling fluid temperature and/or the combustion chamber temperature.

The device which is responsive to the air pressure can be located between the spring plate and the bolt which penetrates the second chamber, and be composed of a barometer case which, with low air pressure, increases the tension between the spring plate and the bolt and has a compression spring which is supported against it. As a result of this arrangement, a reduction of the pressure difference between both chambers and therefore a smaller fuel dosing can be achieved. By linking the device which is responsive to the air pressure to the intake duct, the air pressure prevailing in the intake duct can act directly on the barometer case and the appropriate fuel dosing can consequently be adjusted.

The valve of the differential pressure control valve can be formed with control aperture which is located in the bolt of the first chamber and is connected via a duct to the first chamber in the open state of the valve, and an outflow aperture, which cooperates with this control aperture, is located in the wall of the bore which accepts the bolt and is connected to the backflow pipeline.

In order to obtain a secure sealing of the valve and prevent leaking-through of the fuel which is in the first chamber, the diaphragm can have on its side facing the first chamber, an elastomeric sealing lip which encloses the bolt and rests against the chamber wall in the closed state of the valve.

The invention may be performed in various ways and one specific embodiment will now be described by way of example with reference to the accompanying drawing, which is a diagrammatic view, partly in section, of a fuel injection system with a differential pressure control valve.

Referring to the drawing, reference numeral 1 shows an intake duct of a mixture-compressing, externally ignited internal combustion engine, having an arbitrarily operable throttle valve 2 and a measuring element 3 which moves according to the thrust of air flowing through the duct in the direction of the arrow. The measuring element 3 is constructed in the form of a baffle plate and is located in a conical section 4 of the intake duct 1. The baffle plate 3 is pivotally mounted at 5 and acts upon the movable piston valve 6 of a fuel metering valve 7. The piston valve 6 is located in a cylindrical bore 8, in whose wall are provided a number of control slots 10 corresponding to the number of injection nozzles 9 indicated by arrows. To each control slot 10 is connected a diaphragm valve 11, which has two chambers 13 and 14 separated from each other by a diaphragm 12. Each chamber 13 communicates via a duct 15 with a respective control slot 10 and via a valve aperture 16, which is controlled by the diaphragm 12, with the injection nozzle 9.

A differential pressure control valve 20 forms part of the fuel injection system and has two chambers 22 and 23 which are separated from each other by a diaphragm 21. The chamber 22 is charged with fuel under system pressure, which is determined by a system pressure retaining valve 19, through a pipeline 17 from an electrically driven fuel pump 18. A pipeline 26 branches off from pipeline 17, and communicates through a duct 27 with an annular groove 28 in the piston valve 6 of the fuel metering valve 7. A pipeline 30 also branches off from pipeline 17 and communicates through a throttle point 31 and a pipeline 29 with the chamber 23 of the differential pressure control valve 20 and also through a pipeline 32 with the second chambers 14 of all the diaphragm valves 11.

The diaphragm 21 is actuated from one side by a spring 34 via a bolt 33 which penetrates the first chamber 23, and from the other side by a spring 36 via a bolt 35 which penetrates the second chamber 22. Against the spring 34 rests a device 37 for full-load fuel enrichment and this device comprises a cam 38, which is adjustable by means of a rod mechanism shown diagrammatically by a dash-dot line, in dependence upon the position of the throttle valve 2, and a transmission lever 39 with an adjusting screw 40, with which a balance between the mutually acting springs 34 and 36 is produced. Against the spring 36 rests a device 41 for cold-starting fuel enrichment, which is essentially composed of a thermoelement 42 and a spring plate 45, which is located in a housing 43 and is able to move as far as an abutment surface 44. The thermoelement 42 is located in a chamber 48, through which cooling fluid flows via the connections 46 and 47, and can expand further via a spring 49 when the spring plate 45 abuts surface 44 during heating of the thermoelement 42. On the thermoelement 42 is also fixed a heating element 50, which, can be supplied with electric current via the contact 51. Between the spring plate 45 and the bolt 35 is located a device 52 which reacts to the air pressure, and which is composed of a barometer case 53 and an intermediate compression spring 54. The differential pressure control valve 20 together with the device 37 for full-load enrichment, the device 41 for cold-starting concentration and the device 52 which reacts to the air pressure forms a compact structural unit.

The pressure in the chamber 23, which determines the differential pressure at the metering valve 7, in controlled by the three devices 37, 41 and 52, which can press against the diaphragm 21 on both sides and release the valve 63 of the differential pressure control valve 20. The valve 63 includes a control aperture 55, which is located in the bolt 33 and is connected through a duct **54*a* to the chamber 23, and by an outflow aperture 56, which cooperates with the control aperture and which is located in the wall of the bore 57 which accepts the bolt 33 and is connected to a back-flow pipeline 59 which opens into the fuel tank 58. By means of the adjusting screw 40, the prestress of the spring 34 and also the tension of the spring 36 and of the spring 54 can be adjusted in such a way that the differential pressure in the metering valve 7** can be obtained as desired.

The fuel which is conveyed by the fuel pump 18 passes through the pipeline 17 not only into the chamber 22 of the differential pressure control valve 20, but also through the pipeline 26 and the duct 27 into the annular groove 28 of the piston valve 6, while a partial current of the fuel passes through the pipeline 32 into the chambers 14 of each diaphragm valve 11, and also through the pipeline 29 into the chamber 23. The piston valve 6 is moved upwards out of the resting position shown by the baffle plate 3 in response to its deflection by the air flowing through the intake duct 1, against a counter-force which, in the exemplified embodiment, is created by a spring 60, whereby its control edge 61 releases the control slots 10 in proportion to the deflection of the baffle plate 3. The fuel consequently passes through the ducts 15 into the first chambers 13 of the diaphragm valves 11, from where it flows through the valve apertures 16 to the appropriate injection nozzles 9.

In order to ensure that the quantity of fuel supplied to the injection nozzles 9 corresponds to the respective operating state, the differential pressure is determined in dependence upon the three devices 37, 41 and 52, which vary the prestress of the springs 34, 36 and 54 which press against the diaphragm 21. A rotation of the cam 38 in dependence upon the position of the throttle valve 2 leads, for example, to an increase in the prestress of the spring 34 and in a direction which opens the valve 63, and therefore to fuel enrichment with a full load. Fuel enrichment during cold-running of the internal combustion engine is achieved by retracting the pin **42*a* of the thermoelement 42, and thereby reducing the prestress of the spring 36. As a result, the valve 63 is likewise actuated in an opening direction via the bolt 35 and the diaphragm 21. A reduced fuel dosing during falling air pressure occurs by means of the barometer case 53 expanding and the tension between the spring plate 45 and the bolt 35 increasing via the spring 54, whereby the valve 63 is actuated via the bolt 35** in a closing direction. Depending upon the operating state, there naturally arise intermediate positions under the influence of the various operating parameters, which, as a result of the illustrated arrangement produce an appropriate metering of fuel.

In order to prevent fuel flowing from the chamber 23 through the valve 63 after the internal combustion engine has been stopped, and thereby impairing the readiness for starting, especially with a warm engine, the diaphragm 21 has a sealing lip 62 on its side facing the chamber 23. The sealing lip 62 surrounding the bolt 33 comes into sealing abutment against the facing chamber wall, as a result of the pressure in the chamber 22, which is higher at this point in time, whereby the chamber 23 is additionally sealed in relation to the outflow aperture 56.

Many modifications of the exemplified embodiment represented are obviously possible without departing from the framework of the invention. The cam 38 can, for example, be of such a shape as to make it possible for a fuel saving to follow a fuel enrichment during full load, and the spring 34 therefore actuated in a direction which reduces its tension and the valve 63 in the closing direction. It is also possible for the differential pressure control valve 20 and the devices 37, 41 and 52 to be located directly on the intake duct 1, whereby the throttle valve 2 can be coupled directly to the cam 38. In this case, the direct communication between the inner chamber of the housing 43 with the barometer case 53, and the intake duct 1, can be produced so that for example, with a supercharged engine, the fuel dosing is appropriate to the air pressure prevailing in the intake duct. When the engine is not supercharged, any soiling and clogging of the air filter which may possibly occur, can have no disadvantageous effect on the fuel dosing through this communication, as the barometer case 53 equalizes the pressure differences caused thereby, which are transmitted to the metering valve 7. As a further modification of the exemplified embodiment, the thermoelement 42 which reacts to the engine temperature, can be replaced by an electrical or hydraulic servomotor, which can be adjusted by known means in dependence upon the temperature of the combustion chamber.

We claim:

1. A fuel injection system for a mixture compressing internal combustion engine with spark ignition having a fuel injection nozzle for continuous fuel injection, an air intake duct, and an adjustable throttle valve in said intake duct, comprising: a flow sensing element in the intake duct arranged to move in accordance with the quantity of air flowing through said intake duct; a fuel metering valve, actuated by said flow sensing element, for dispensing a quantity of fuel which is substantially proportional or related to the quantity of air; means for maintaining a substantially constant pressure difference across the metering valve including a pressure sensitive valve having two chambers separated from each other by a movable partition element, and a differential pressure control valve which also has two chambers separated from each other by a movable partition element; the first chamber of said pressure sensitive valve being subject to the pressure downstream of said metering valve, and comprising a valve aperture controlled by the associated partition element, said first chamber communicating with the fuel injection nozzle through the valve aperture; while the second chamber of said pressure sensitive valve communicates with the first chamber of said differential pressure control valve; a spring-loaded valve element element which is controlled by the partition element of said differential pressure control valve; a return line, said first chamber of said differential pressure control valve communicating with said return line via said spring loaded valve element, while the second chamber of said differential pressure control valve is actuated by the pressure upstream of said metering valve, and the partition element of said differential pressure control valve is actuated on both sides by resilient elements, whose loading stress can be varied according to engine operating parameters.

2. A fuel injection system according to claim 1, comprising a device for full-load fuel enrichment, a device for cold-start fuel enrichment and a device responsive to the air pressure which act upon said resilient elements, said devices adjusting the loading stress of said resilient elements such that said valve element which is controlled by said partition element of said differential pressure control valve is actuated in the opening direction at full load and cold-start, and is actuated in the closing direction when the air pressure falls.

3. A fuel injection system according to claim 2, in which one of said resilient elements bears against one side of said differential pressure control valve partition element by means of a projecting member which penetrates said first chamber and the other of said resilient elements bears against the other side of said partition element by means of a projecting member which penetrates said second chamber.

4. A fuel injection system according to claim 3 in which said device for full-load enrichment rests against said one of said resilient elements which bears against said one of said partition elements and, depending upon the position of the throttle valve, is moved at full load for increasing the load stress of said resilient element.

5. A fuel injection system according to claim 3 in which said device for cold-start enrichment rests against said another of said resilient elements which bears against said other side of said partition element, and in which an adjusting element responsive to the engine temperature is provided for increasing the load stress of said resilient element.

6. A fuel injection system according to claim 2 in which said device which is responsive to the air pressure is located between a spring plate and a projecting member penetrating said second chamber of said differential pressure control valve and is composed of a bellows in series with a compression spring for increasing the tension between said spring plate and said projecting member when the said pressure is reduced.

7. A fuel injection system according to claim 3 in which said valve which is controlled by said partition element of said differential pressure control valve is formed with a control aperture, which is located in said projecting member which penetrates said first chamber of said differential pressure control valve and is connected via a duct to said first chamber in the open state of the valve, and an outflow aperture, which cooperates with said control aperture, is located in the wall of a bore which accepts said projection member and is connected to the return line.

8. A fuel injection system according to claim 3 in which a resilient sealing lip is formed on the side of the partition element of said differential pressure control valve which faces said first chamber, said sealing lip surrounding said projecting member which penetrates said first chamber, and said sealing lip resting against said first chamber wall when said valve is closed.

* * * * *